United States Patent [19]

Lee

[11] 4,074,775

[45] Feb. 21, 1978

[54] POWER SWIVEL

[75] Inventor: William T. Lee, Harvey, La.

[73] Assignee: Fishing Tools, Inc.

[21] Appl. No.: 688,464

[22] Filed: May 20, 1976

Related U.S. Application Data

[63] Continuation of Ser. No. 552,810, Feb. 25, 1975, abandoned.

[51] Int. Cl.[2] ..... E21B 3/06

[52] U.S. Cl. ..... 173/79; 173/163; 418/248

[58] Field of Search ..... 173/57, 105–108, 173/163, 79; 418/248

[56] References Cited

U.S. PATENT DOCUMENTS

| | | | |
|---|---|---|---|
| 1,605,712 | 11/1926 | Gilman | 173/105 |
| 3,595,270 | 7/1971 | Bartos | 173/57 X |
| 3,858,666 | 1/1975 | Bailey et al. | 173/105 X |
| 3,908,767 | 9/1975 | Klemm | 173/78 |
| 3,949,818 | 4/1976 | Russell | 173/57 |

*Primary Examiner*—Ernest R. Purser
*Assistant Examiner*—William F. Pate, III
*Attorney, Agent, or Firm*—Pravel, Wilson & Gambrell

[57] ABSTRACT

A power swivel particularly adapted for downhole cementing operations. The power swivel includes a housing having a fluid passageway therethrough and a stem assembly mounted for rotational movement with respect to the housing and having a fluid passageway communicating with the housing passageway. A hollow bore motor mounted with the housing receives the stem assembly through a central bore of the motor and rotates the stem assembly with respect to the housing.

5 Claims, 5 Drawing Figures

238
S
96
20
92
136b
94
102
98
100
136c
H
F'
108
110
242
104
106
138
114
112
116
12
118
152
120
124
126
168
154
156
20a
158
128
160
20b
122
162
178
175
173
171
M
167
166
172
176
170a

M'
170b
173a
170c
166
174
172
176
M'
170a
170b
176
174
172
M'
164
190
194
198
180
196
186
192
188
200
238
S

POWER SWIVEL

CROSS-REFERENCES TO RELATED APPLICATIONS

This application is a continuation of application Ser. No. 552,810, filed Feb. 25, 1975, abandoned on June 13, 1976.

BACKGROUND OF THE INVENTION

The field of this invention is power swivel assemblies and the like.

Power swivel assemblies and assemblies having power subs coupled to conventional drilling swivels are most frequently used in oil field operations requiring the rotation of pipe. While there are a number of such operations, power swivels and power subs are particularly useful for rotating casing during downhole cementing operations.

Known power swivels and power subs typically included a rotatable stem, an upper end of which was coupled with a swivel member. The stem was rotated by a motor and a gear train interconnecting the motor to the stem. The gear train often included a bull gear rigidly affixed to the stem and extending radially therefrom to engage a mating drive gear mounted on the drive shaft of the motor. The motor was spaced radially from the stem to facilitate alignment of the drive gear and the bull gear.

While such known power swivels and power subs did achieve a rotation of the stem, there were several disadvantages attendant to their use. Because the motor was radially spaced from the stem, such assemblies often did not have a center of gravity along their longitudinal axis. This displacement of the center of gravity made the unit difficult to handle. Additionally, the center of gravity of the assemblies could not readily be aligned with the center line of the borehole. As a result, the assemblies exerted at least some torque on the stem and on the pipe being rotated. This was particularly disadvantageous when the assembly was being used to run flexible, lightweight tubing. The radial spacing of the motor from the stem also exposed the motor to damage by being hit with other apparatus being brought to, removed from, or otherwise utilized on the rig platform. Further, the positioning of the motor reduced the working space available on the rig platform. An additional disadvantage of the known assemblies related to the use of the interconnecting gear train to rotate the stem. Such gear trains were somewhat expensive, required maintenance, and resulted in some power loss in the transmission of power from the drive motor to the rotatable stem.

SUMMARY OF THE INVENTION

It is an object of this invention to provide a new and improved power swivel.

The power swivel of the present invention includes a housing having a fluid passageway therethrough and a stem assembly mounted for rotational movement with respect to the housing. The stem assembly also has a fluid passageway communicating with the fluid passageway through the housing. A hollow bore motor means is mounted with the housing and engages the stem assembly to rotate the stem with respect to the housing.

The motor means, which preferably consists of one or more vane type hydraulic motors, includes an inner receiving member connected to the vanes of the hydraulic motor. This inner receiving member additionally forms a central bore through the motor for receiving and operably engaging the stem assembly. A plurality of interengaging spline members are formed on the receiving member of the motor and on the stem assembly to connect the stem assembly to the motor. The motor is thus directly connected to the rotatable stem assembly and extends circumferentially around the assembly rather than being spaced radially from it. By providing a direct drive for rotating the stem assembly, the present invention eliminates the need for the interconnecting gear trains employed with known power swivels. The direct drive structure of the present invention thus eliminates the cost and maintenance disadvantages associated with the interconnecting gear trains of known power swivels and also provides a more efficient power swivel by eliminating the power losses attributable to the gear train of the known swivels. Further, since the motor extends circumferentially around the stem rather than being spaced radially from it, the motor is less likely to be damaged by being struck with other apparatus being moved about on the rig platform. Additionally, since the motor is not extended radially outward from the stem, more working space is available on the rig platform.

The housing, stem assembly, and motor means are all symmetrical about a central axis of the power swivel. This concentric mounting of the elements of the power swivel of the present invention ensures that the center of gravity of the power swivel is along a line defined by the central axis. Accordingly, the power swivel of the present invention is easy to handle and may readily be aligned with the center line of a borehole. The symmetrical power swivel of the present invention also minimizes the undesirable torques placed on the stem and rotated pipe by known, non-symmetrical power swivels.

During many applications of the power swivel of the present invention, fluids such as drilling mud and cement are passed through the fluid passages of the housing and the rotating stem. To ensure that these abrasive fluids do not escape from the passageways and interfere with the rotation of the stem assembly, a wash plate is provided at the interface of the housing passageway and the stem assembly passageway. This wash plate is mounted with the housing, but also extends down to and engages the rotatable stem assembly to form a seal for the housing and stem assembly passageways. In this manner, a seal is formed at the interface of the passageways even as the stem assembly is rotating with respect to the housing. By providing such a seal, the wash plate ensures that fluids are confined to the passageways and do not interfere with the rotation of the stem assembly. The power swivel of the present invention thus provides a durable, efficient assembly for use in a number of oil field operations requiring the rotation of pipe.

DETAILED DESCRIPTION OF THE PREFERRED EMBODIMENT

Figures 1, 2C, 3:
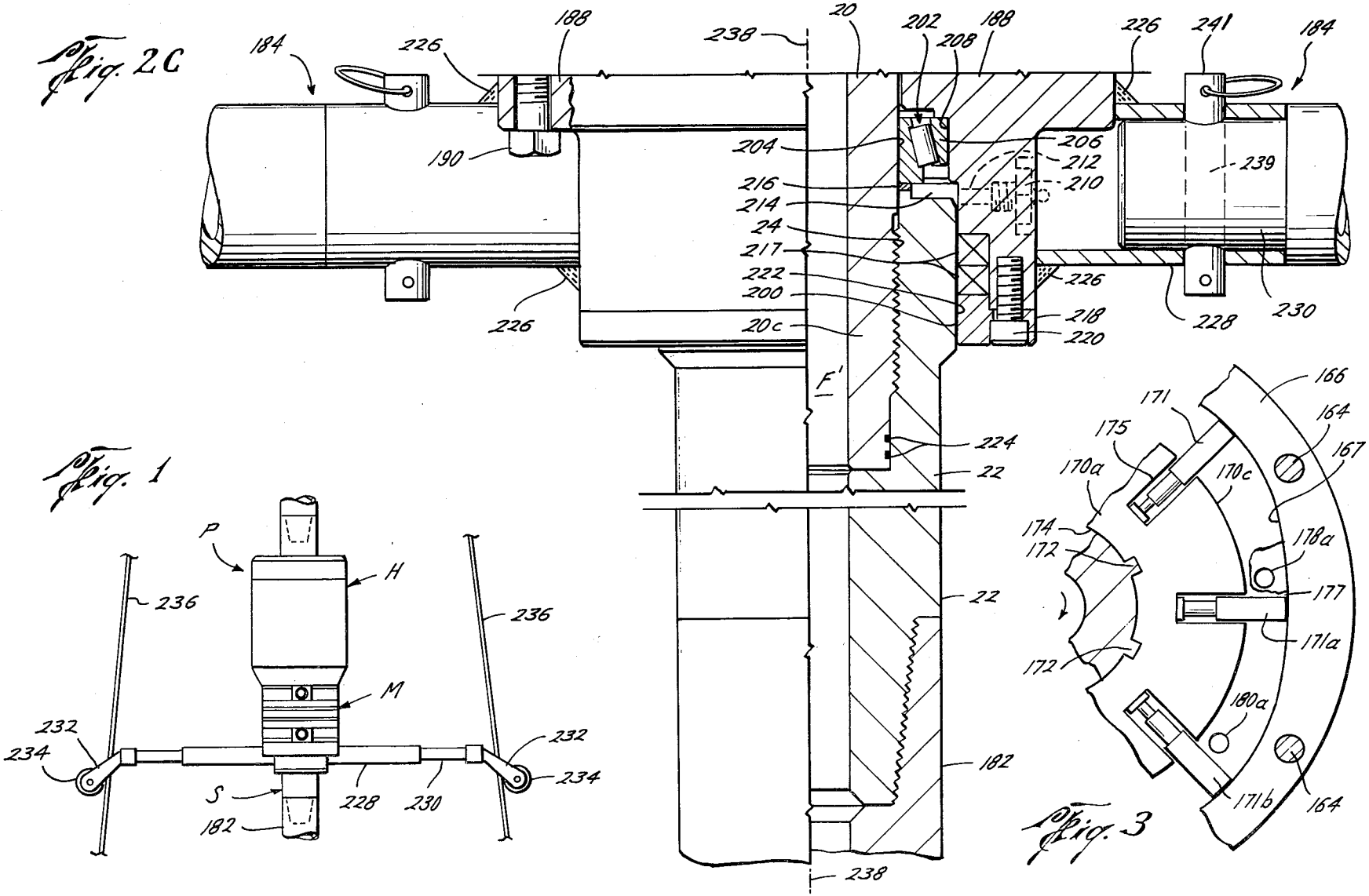
FIG. 1 is an elevation view of the power swivel of the present invention.
FIG. 2C is an elevation view, taken partly in cross section, of a lower portion of the power swivel of the present invention.
FIG. 3 is a top sectional view illustrating a section of a motor employed with the present invention.

In the drawings, the letter P designates generally the power swivel of the present invention which includes a housing H, a stem assembly S mounted for rotational movement with respect to the housing, and a motor means M mounted to the housing H. The motor means M is a hollow bore motor which receives and engages stem assembly S in a central bore in the motor and rotates the stem S with respect to housing H. The housing H has a fluid passageway F and the stem assembly S has another fluid passageway F' which communicates with passageway F to form a continuous flow passageway through the power swivel P so that mud, cement, or other suitable fluids may be passed through the passageway F and F' at appropriate times during the operation of power swivel P.

Considering the invention in more detail, housing H includes an upper housing member 10 and a lower housing sleeve 12 which threadedly engages the upper housing member 10 by threads 14 formed on the upper housing member 10 and the sleeve 12. Preferably, threads 14 are left-hand threads, and upper housing member 10 is formed with a partially threaded recess 16 to receive a locking screw 18 for holding the two housing members in proper spatial relationships with one another.

The stem assembly S includes two stem members, a splined stem 20 and a coupling stem 22. An upper portion **20*a* of splined stem 20 is received within housing sleeve 12 and mounted for rotational movement with respect to the housing H. A mid-portion 20*b* of splined stem 20 extends through a central bore of motor means M, operably engaged by the motor means, and rotated with respect to housing H. The lower portion 20*c* of splined stem 20 emerges from the motor means M and threadedly engages coupling stem 22 by means of threads 24 formed on the stem portion 20*c* and coupling stem 22**.

As previously noted, power swivel P is particularly adapted for use in downhole cementing operations. At appropriate times during such operations, cement and drilling mud are passed through the pasageway F and F' at very high pressures. These fluids are, of course, abrasive, and it is desirable to prevent the fluids from seeping between the stem assembly S and the housing H where such fluids would impede the rotational movement of the stem assembly S with respect the housing H. To form a seal between the stationary passageway F of the housing M and the rotating passageway F' of the stem assembly S, power swivel P is provided with a wash plate or wash pipe 26 at the interface 28 of the passageways. The wash plate 26 extends between the two passageways F and F', engaging an inner surface 30 of upper housing member 10 and an inner surface 32 of the upper splined stem portion **20*a*. The wash plate 26 is mounted with the upper housing member 10 by an annular flange 34 which is received in a recess 36 of wash plate housing cap 38. A screw 40 is countersunk in wash plate housing cap 38 and extends through the cap to threadedly engage upper housing member 10. As screw 40 is drawn tight, flange 34 is frictionally secured between a shoulder 42 of cap 38 and a shoulder 44 of upper housing member 10. Wash plate 26 is thus held immobile with respect to the upper housing member 10, and forms a static seal at the interface of the wash plate 26 and the inner wall 30 of upper housing member 10. A pair of O-rings 46 are also provided at the interface of wash plate 26 and inner wall 30** to further ensure an effective static seal at those surfaces.

Wash plate 26 forms both a static and a sliding or rotational seal between the fluid passageway F and F' at the inner wall 32 of upper splined stem portion **20*a*. A recess 48 is formed in the upper stem portion 20*a* to receive packing material 50 and a pair of rings 52 and 54 on the upper and the lower sides of the packing material 50. Preferably, the packing material 50 consists of a plurality of commercially available V-rings formed of molded fabric packing material. The upper ring 52, which has one surface conforming to the shape of the packing material 50, engages an inner lip 56 of a wash plate stem cap 58. The wash plate stem cap 58 has a screw 60 countersunk in the cap 58 and threadedly engaging the upper splined stem 20*a*. With screw 60 drawn tight, cap 58 is rigidly secured to upper splined stem portion 20*a* to provide lateral support for the wash plate 26 and to hold the ring 52 and packing material 50 within recess 48. Preferably, the lower ring 54 is spring loaded and urges the packing material 50 upwardly so that ring 52 is in firm contact with the lip 56 of wash plate stem cap 58 and the packing material 50 is held compactly within the recess 48. Thus, wash plate 26 in conjunction with the packing material 50 forms a seal which is a sliding or rotatable seal when splined stem 20 is rotating and also is a static seal when the splined stem 20** does not rotate.

As can be seen from the above description, wash plate 26 and its associated structure form an effective seal between housing H, stem assembly S, and the fluid passageways F and F'. Fluids flowing through the passageways F and F' are prevented from flowing or seeping into the areas between the housing H and the stem assembly S, either as the stem assembly S is rotating with respect to the housing H or when the stem assembly S is not rotating. The fluids passed through power swivel P are thereby confined to the fluid passageways F and F'.

To minimize the friction between the housing H and the rotatable splined stem 20, a spacing or lubricating cavity 62 is provided between a lower surface 64 of upper housing member 10 and an upper surface 66 of upper splined stem portion **20*a*. The spacing or cavity 62 is provided by maintaining the proper spatial relationships between the housing members and the stem assembly as set forth in more detail hereinafter. The cavity 62 is bounded by wash plate 26, wash plate stem cap 58, stem surface 66, a safety ring 68, and wash plate housing cap 38. A means is provided to supply the lubricant cavity 62 with an appropriate lubricant, such as grease. As shown in FIG. 2A, upper housing member 10 may be provided with a grease fitting 70 and a lubricant conduit or passageway 72 placing the grease fitting 70 in communication with the lubricant cavity 62. The lubricant can then be injected into grease fitting 70, the lubricant passageway 72 and into the cavity 62 where it is held by the elements bounding the cavity 62. In this manner, a lubricant is provided between the upper housing member 10 and the upper splined stem 20*a* to reduce friction between the upper housing member 10 and the splined stem 20** as the splined stem rotates with respect to the housing H.

Power swivel P is additionally provided with a plurality of roller bearings which facilitate the rotation of the stem assembly S with respect to the housing H. A first such roller bearing is an inclined roller bearing 74. An inner race 76 of bearing 74 engages a shoulder 78 of upper splined stem 20*a* and an outer race 80 of the inclined bearing engages shoulder 81 of a bearing cap 82. The bearing cap 82, in turn, threadedly engages housing sleeve 12 by means of threads 84 formed on cap 82 and housing sleeve 12. Preferably, threads 84 are right-hand threads, and housing sleeve 12 is provided with a locking screw 86 which extends through the sleeve 12 and engages bearing cap 82 at a recess 88 formed in the bearing cap. By extending between the cap 82 and the housing 12 beneath the threads 84, locking screw 86 ensures that locking cap 82 remains in the proper threaded engagement with sleeve 12. Additionally, locking screw 86 may be used to exert a force on bearing cap 82 so that the bearing cap maintains the desire to mount force on bearing 74 for the proper functioning of the bearing. Bearing cap 82 is also provided with a recess 90 to receive a spanner wrench for removal of the bearing cap during replacement or inspection of bearing 74. Similarly, upper splined portion 20*a* is provided with a recess 119 to permit replacement or inspection of other bearings in the bearing assembly.

Figure 2A:
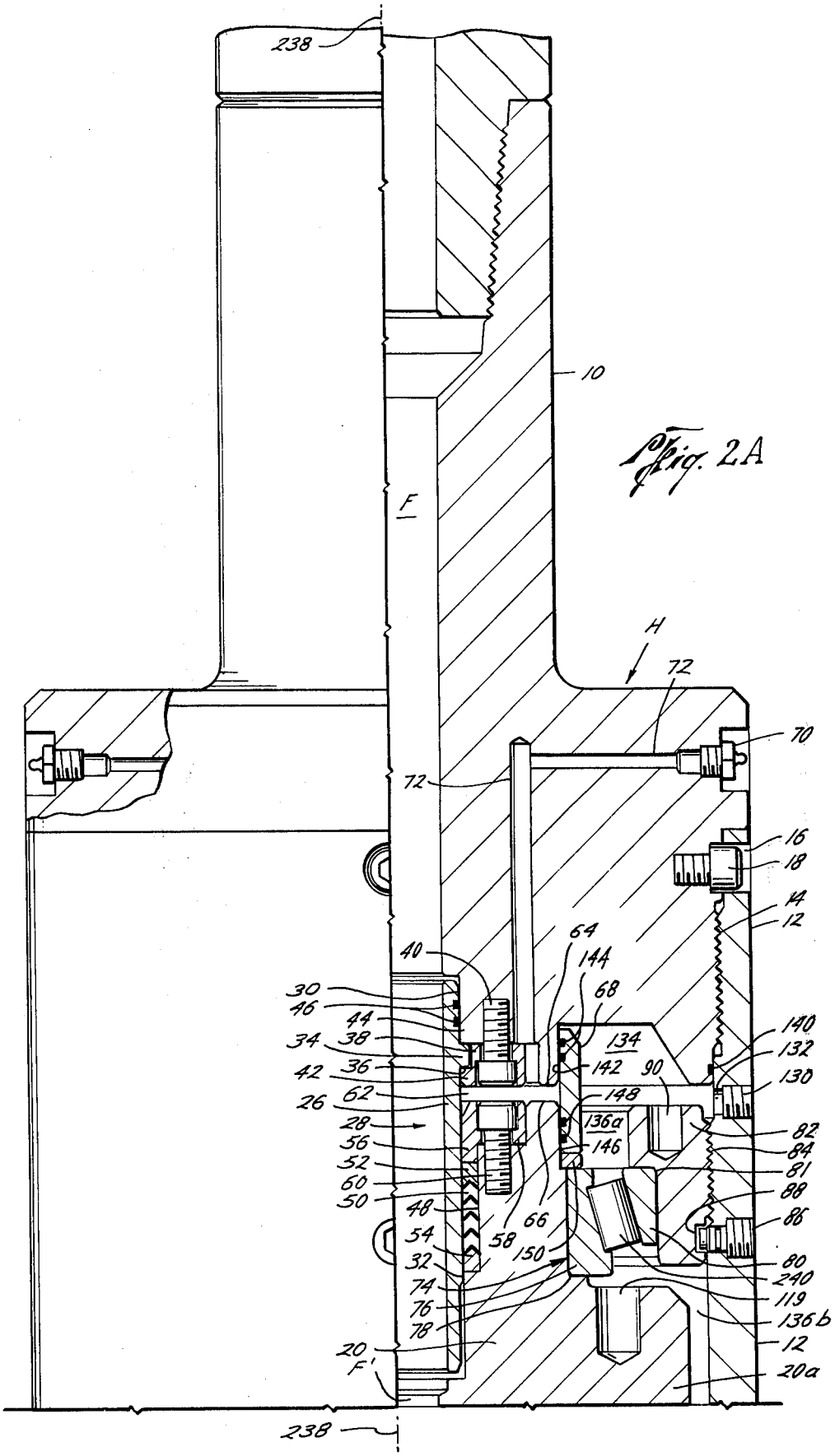
FIG. 2A is an elevation view, taken partly in cross section, of an upper portion of the power swivel of the present invention.
Figure 2B:
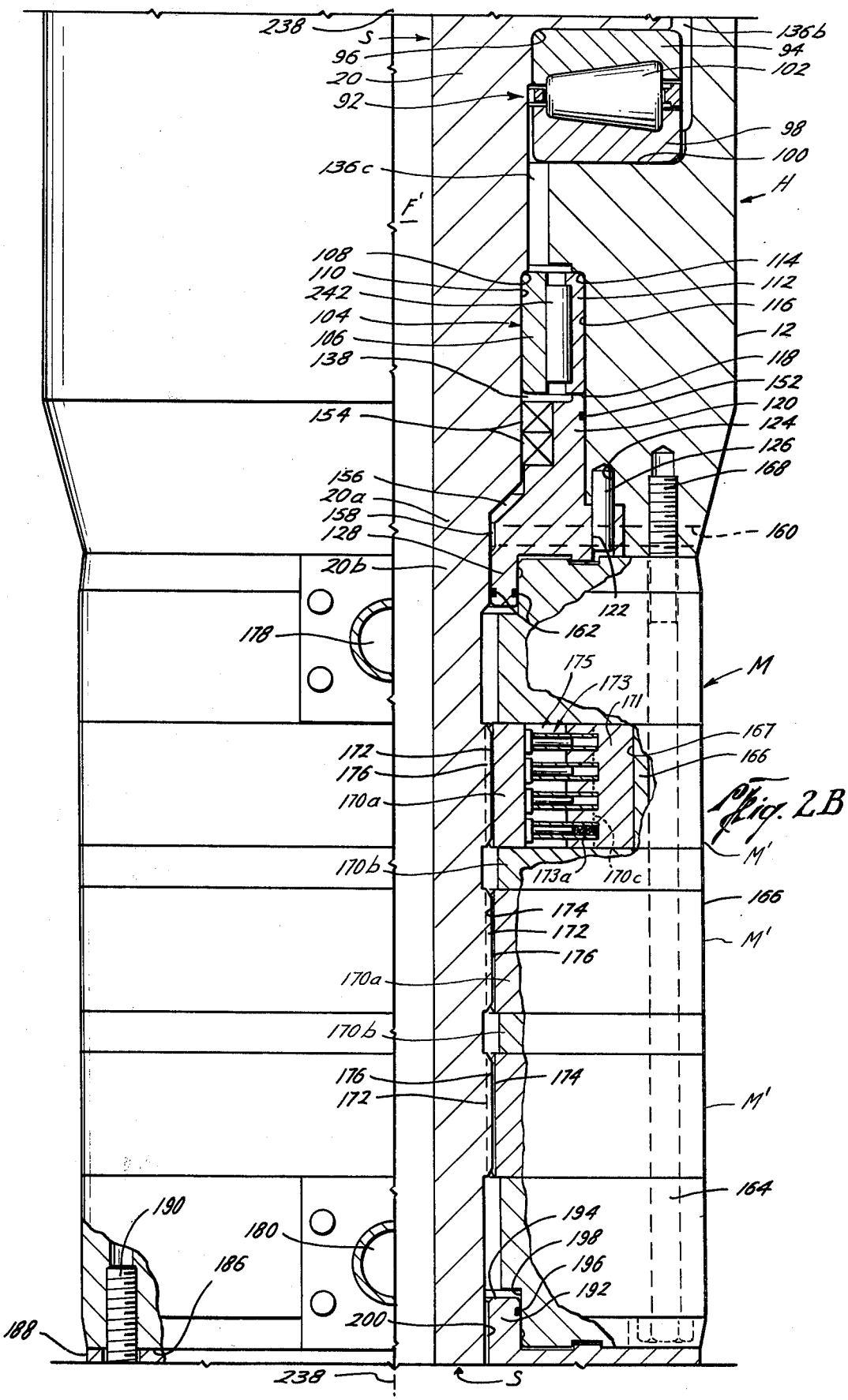
FIG. 2B is an elevation view, taken partly in cross section, of a mid-portion of the power swivel of the present invention.

The bearing assembly of the power swivel P additionally includes tapered roller bearing 92 (FIG. 2B). The tapered roller bearing 92 is mounted in a substantially horizontal position with upper race 94 of the bearing engaging a shoulder 96 of splined stem 20 and a lower race 98 of the bearing engaging a shoulder 100 of housing sleeve 12. As shown in FIG. 2B, a tapered end 102 of the roller is directed inwardly toward the splined stem 20 for a purpose to be explained in more detail hereinafter.

A vertical bearing 104 is also included in the bearing assembly of power swivel P. An inner race 106 of the vertical bearing 104 engages a shoulder 108 of a recess 110 in splined stem 20, and an outer race 112 engages a shoulder 114 in a recess 116 formed in housing sleeve 12. Additionally, the outer race 112 of bearing 104 engages an upper lip 118 of an adapter 120. The adapter 120 is formed to fit beneath vertical bearing 104 and engage the bearing, splined stem 20, motor means M, and housing sleeve 12. With the support received from these adjacent members, adapter 120 maintains bearing 104 in its proper position in recesses 110 and 116. Additionally, adapter 120 has a recess 122 which is alignable with recess 124 in housing sleeve 12. The recesses 122 and 124 receive an alignment pin 126 which extends between the adapter 120 and the sleeve 12. Adapter 120 is additionally formed with a lower flange 128 which extends between the motor means M and the splined stem 20. This leg 20 forms a spacer so that when alignment pin 26 is positioned to extend between the housing sleeve 12 and the adapter 120, the housing sleeve 12, the splined stem 20, and the motor means M are all maintained at a constant, desired lateral spacing with respect to one another. By maintaining this lateral spacing between the housing sleeve 12, the splined stem 20, and the motor means M, adapter 120 ensures that the proper spacing is maintained between recess 116 and recess 110 to accommodate vertical bearing 104 and, at the same time, provide the requisite pressure on the bearing races 106 and 112 to insure the proper functioning of the vertical bearing 104. Additionally, of course, this maintenance of the proper spacing between the housing sleeve 12, the splined stem 20 and motor means M ensures a similar spacing arrangement for the tapered bearing 92.

Power swivel P is also provided with a means for lubricating the above described bearing assembly. A fill plug 130 is provided in a bore 132 formed through housing sleeve 12 to provide access to an oil chamber or space 134 provided between the housing member H and the upper splined stem portion 20*a*. A plurality of passageways 136*a*–136*c* join the roller bearings 74, 92, and 104 with the oil cavity 134 to provide lubrication for the roller bearings. Oil from cavity 134 communicates through the passageway 136*a* to inclined bearing 74, through a roller 138 of bearing 74 and passageway 136*b* to tapered bearing 92, and through the tapered roller 102 of bearing 92 and passageway 136*c* to vertical bearing 104. Additionally, the oil may flow through the vertical bearing 104 and into a small reservoir 138 beneath the vertical bearing 104. In this manner, each of the roller bearings, 74, 92, and 104 receives oil from the oil cavity 134 for lubrication during the operation of swivel cap P.

To retain the oil in the reservoir 134 and the passageways 136*a*–136*c*, a plurality of seals are provided. A first seal 140 is provided between the upper housing member 100 and the housing sleeve 112 to ensure that oil does not flow between the two housing members and escape from the cavity 134. Additionally, a seal for oil cavity 134 is formed by the safety ring 68. Safety ring 68 frictionally engages a surface 142 of the upper housing member 10 and is provided with a pair of O-rings 144 to ensure that an effective static seal is formed between the oil cavity 134 and the lubricant cavity 62. The safety ring 68 additionally forms a static and rotatable, sliding seal at a surface 146 of the upper splined stem portion 20*a*. An additional pair of O-rings 148 are provided at the interface of the safety ring 68 and the stem surface 146 to ensure that an effective seal is formed between oil cavity 34 and lubricant cavity 62. The safety ring 68 remains stationary or immobily mounted with upper housing member 10, and forms an effective sliding, rotational seal at the surface 146 to prevent the intermingling of the oil in oil cavity 134 and the lubricant in lubricant cavity 62. Additionally, a thrust ring, such as the bronze thrust ring 150 is mounted between the inner race 76 of the inclined bearing 74 and the safety ring 68 to form a wearing surface and a shock absorbing body between the bearing 74 and the safety seal 68 to ensure that the seal formed by the safety ring 68 remains in tact. Other seals are also provided beneath reservoir 138 to ensure that roller bearing oil will not escape from the power swivel P (FIG. 2B). An O-ring seal 152 is provided with adapter 120 and forms a seal at the interface of the adapter and the outer housing sleeve 12. A pair of larger resilient seals 154 are formed on the inner side of adapter 120 immediately beneath reservoir 138. The seal 154 sealably engages the splined stem 20 to form a seal between the adapter 120 and the splined stem 20 to prevent the flow of oil between these two members.

Structure may also be provided for inspecting the operability of the seals 154. As shown in FIG. 2B, a recess 156 can be provided immediately beneath seals 154 and between the adapter 120 and the splined stem 20. The lower portion 158 of the recess 156 communicates with a bore 160 extending through the adapter 120 and the outer housing sleeve 12. Any oil which escapes past the seals 154 flows into recess 156 and passes radially outwardly through the telltale bore 160. Thus, the presence of oil at the telltale bore opening indicates that the seals 154 have worn or otherwise become at least partially defective and that oil is leaking from the bearing lubricating system. This leaking oil is now, however, permitted to pass along the splined stem 20 and into the motor means M. Leg 128 of adapter 120 is provided with a pair of seals 162 which prevent the passage of oil between either the adapter 120 and the splined stem 20 or the adapter 120 and the motor means M. Thus, structure is provided for inspecting the functioning of seals 154 and at the same time, the structure blocks the passage of the oil into the motor means M where the oil might damage the motor or otherwise affect the operation of the power swivel P.

It should also be noted that safety ring 68 serves a function in addition to preventing the intermingling of the oil in oil cavity 134 and the lubricant in lubricant cavity 62. The safety ring 68 additionally forms a backup seal for protecting the roller bearings of the power swivel P in the event that ring 52 fails. If ring 52 were to blow out or otherwise become defective, the abrasive fluids flowing through passageways F and F' under high pressure might flow past the wash plate 26 and into lubricant cavity 62. Safety ring 68 forms a secondary or back up seal for the power assembly P to ensure that any abrasive fluids which might enter lubricant cavity 62 do not flow into oil cavity 134. Rather, the safety ring 68 forms a seal blocking the flow of fluids from lubricant cavity 62 into oil cavity 134 or its communicating passageway 136a. By preventing the seepage of these abrasive fluids into the roller bearing lubricating assembly, safety rings 68 protect the roller bearings from damage due to contact with the abrasive fluids in the event that ring 52 fails.

To impart rotational movement to the stem assembly S, power swivel P is provided with a hollow bore motor means M which receives a mid-portion 20*b* of splined stem 20 through a central bore in the motor means M. While any suitable hollow bore motor may be used with the present invention, in the preferred embodiment illustrated in FIG. 2B, a vane type, high torque, fixed displacement hollow bore hydraulic motor is employed. A motor such as the model MHT-750-1-30 motor commercially available from Sperry Vickers of Troy, Michigan is suitable for use with power swivel P. The hollow bore in such a motor is formed by an inner receiving member 170 which includes a plurality of rotors 170*a* rotatably mounted with interspaced housing wafers 170*b* between the motor sections M.

The rotor 170*a* of each motor segment is directly connected to the motor section vanes 171 by spring guides 173 which are rigidly affixed in slots 175 formed in the rotors 170*b*. Coil springs 173*a* or other resilient members within the spring guides 173, illustrated in their most compressed position in FIG. 2B, urge the vanes 171 outwardly against an inner wall 167 of motor housing 166 so that the vanes 171 continually form a fluid barrier extending across a fluid cavity 177 formed by an inner wall 170*c* of rotor 170*a* and the inner housing wall 167 (FIG. 3).

The illustration in FIG. 3 is a top sectional view of the upper motor section of motor M showing generally the motor operation. The inner housing wall is lobed so that the fluid chamber 177 varies in volume circumferentially around the motor segment. However, the vanes are kept in constant contact with the inner housing wall by the springs 173*a* as the vanes move along the cavity in the direction indicated by the arrow in FIG. 3.

One or more inlet ports 178*a* are provided in each motor segment to introduce hydraulic fluid into chamber 177 substantially at a point where the chamber cavity 177 has its smallest volume. The fluid moves the vane 171*a* in the direction of the arrow and thereby imparts rotational movement to the rotor 170*a*.

The vane moves within the chamber and arrives at the position indicated generally by vane 171*b*. At this point fluid is expelled from the chamber through an outlet port 180*a* which is in communication with an inlet port of the next lower motor segment where the fluid is again used to impart movement to vanes 171 in the next lower motor segment.

It should be understood, of course, that each motor segment may have a plurality of vanes and a plurality of inlet and outlet ports for supplying hydraulic fluid to move the vanes within the motor segment. A motor inlet port 178 and a motor outlet port 180 are, of course, provided through the motor housing 166 and for fluid communication with the motor segment inlet ports 178*a* and outlet ports 180*a* to provide a suitable supply of hydraulic fluid to the motor M.

The receiving member 170 has a plurality of female splined structures 172 opening into the hollow bore and formed on an interior surface 174 of the inner receiving member 170. The mid-portion 20*b* of the splined stem 20 includes a plurality of male splined members 176 which mate with the female spline members 172 of the inner receiving member 170. The spline structures 172 and 176 thus form an intermeshing drive means by which the splined stem 20 is connected to the vanes of the motor means M. Since the splined stem 20 is directly mounted with the inner receiving member 170, the stem 20 is rotated directly by the rotational movement of the motor vanes. With this structue, the power swivel P provides a direct drive for the stem assembly S. Since the splined stem 20 is directly mounted with the coupling stem 22, a direct drive power swivel is provided for rotating the pipe or other member 182 affixed to the coupling stem 22.

Of course, as the stem assembly S rotates with respect to the housing H, some torque is applied to the housing H. To keep such torques from rotating housing H, power swivel P is provided with torque resisting arms 184 which are mounted to the base 186 of motor M by a mounting ring 188. The mounting ring includes a plurality of bores alignable with corresponding bores through the base 186 motor M so that bolts 190 may be extended through the mounting ring 188 to threadedly engage the base of the motor and secure the mounting ring to the motor M. The mounting ring 188 additionally includes an upwardly extending flange 192 which extends into a recess 194 formed in the base 186 of motor M. An O-ring 196 is mounted on the flange 192 to insure that the flange engages the inner wall 198 of the recess 194. An inner wall 200 of the mounting ring 188 is spaced slightly from the splined stem 20 so that the stem freely rotates against a roller bearing 202 (FIG. 2C). An inner race 204 of roller bearing 202 engages the splined stem 20 while an outer race 206 of the bearing engages a shoulder 208 formed in the mounting ring 188. To ensure that the roller bearing 202 is adequately lubricated, a grease fitting 210 and lubricant conduit or passageway 212 may be formed into the mounting ring 188 to provide a means to supply a lubricant to the bearing 202. A small reservoir 214 is provided between the roller bearing 202 and the coupling stem 22 to hold the lubricant for the roller bearing. A seal 216 is provided on the inner surface of reservoir 214 to prevent the leakage of lubricant from the reservoir. Additionally, two seals 217 are provided between the coupling stem 22 and the mounting ring 188 to prevent seepage of the lubricant along the inner face of the coupling stem 22 and the mounting ring 188. To hold the seals in their proper positions, a cap 218 is provided beneath the seal, and a countersunk lock screw 220 extends through the cap 218 and threadedly engages the mounting ring 188 to secure the cap 218 to the mounting ring 188. An inner surface 220 of cap 218 engages the outer surface 222 of coupling stem 22 to provide additional lateral support for the stem assembly S. An additional seal, such as the pair of O-rings 224, is also provided between the splined stem 20 and the coupling stem 22 to ensure that lubricant which might seep through seal 216 does not pass into the fluid passageway F and F'.

The torque resisting arms 184 are immovably mounted such as by welds 226, to the mounting ring 188 and provide structure for resisting the torque on housing H due to the rotational movement of the stem assembly S with respect to the housing. Since the mounting ring 188 is rigidly mounted to the base 186 of motor M which, in turn, is rigidly affixed to the outer housing sleeve 12, the torque resisting arms 184 are immobile with respect to the housing H. The arms 184 include an outer tube 228 and an inner telescoping tube 230. A bifurcated connector 232 is mounted to the telescoping tubes 230 and join the tubes with a rotatable wheel 234. As illustrated in FIG. 1, cables 236 which are secured against movement, can be extended through the bifurcated connectors 236 and provide support for the torque resisting arms 184.

In normal operation of the power swivel P the torque resisting arms 184 are connected to the cables 236 to secure the housing H against torques due to the rotational movement of the stem assembly S with respect to the housing H. Since the torque resisting arms 184 are immobile with respect to the housing, any torques which tend to rotate the housing H also tend to rotate the torque resisting arms 184. However, since the torque resisting arms 184 are operably engaging the cables 236 which resist rotational movement, a counter torque is transmitted through the torque resisting arms to the housing H to eliminate any substantial rotational movement of the housing H.

The bifurcated connecting structure of the torque resisting arms 184 in conjunction with the rollers 234 is particularly useful when the power swivel P is to be used in downhole cementing operations. During these operations, the casing is reciprocated vertically as well as being rotated by the power swivel P. By providing the bifurcated connectors 232 and rollers 234, the torque resisting arms and the remainder of the power swivel P can be moved vertically, but at the same time, resist rotational movement of the housing H. As the power swivel P is moved vertically, the telescoping tubes 230 move radially within the outer tube 238 to maintain operable engagement with the cable 236.

However, the telescoping arms 184 are also provided with structure which can be utilized to lock the telescoping tubes 230 in a fixed position with respect to the outer tubes 238. Both the tubes 228 and 230 are provided with a bore 239 for receiving a locking pin 241. When the locking pin is inserted, as for transportation of the power swivel P or the non-use of the torque resisting arms 184, the inner telescoping tube 230 is held immobile with respect to the outer tube 228 so that the inner tube 230 will not extend radially when such movement is not desired.

The power swivel P is constructed to be durable and capable of withstanding the adverse torques and forces exerted on power swivels in many oil field operations. The housing H, stem assembly S, and motor M are all secured against vertical and horizontal displacement with respect to one another. Lateral stability of these members is provided not only by the adapter 120 as previously described, but also by the threaded engagement of upper housing member 10 and outer housing member sleeve 12, the threaded engagement of housing sleeve 12 and bearing cap 82, the bolted mounting of motor M to outer housing 12, the bolted mounting ring 188 to the motor means M, and the engagement of cap 218 with the coupling stem 22. Further, vertical stability of the spatial relationship of the elements of power swivel P is further ensured by the locking screws 18 and 86 as well as the bolting of the motor M to the outer housing and the bolting of the mounting ring 188 to the motor 186. The elements of the power swivel P are thus secured against both horizontal and vertical movement with respect to one another. This ensures the maintenance of lubricant cavity 62 and oil cavity 134 for proper lubrication of the rotating elements of the assembly. Additionally, it ensures that loads are placed on the roller bearings in the proper directions to increase the life of the roller bearings and to ensure the minimization of the friction between the housing H and rotating stem assembly S. In this regard, it should be noted that the rollers of the roller bearings in the swivel P are positioned at varying angles with respect to a center longitudinal axis 238 of the power swivel. The roller 240 of bearing 74 is at an obtuse angle with respect to the axis 238, the tapered roller 102 of bearing 92 is perpendicular to the axis 238 and the roller 242 of vertical bearing 104 is parallel to the axis. The diversity of angles of the rollers ensures that loads in varying directions will be properly transmitted to the roller bearing assembly to maintain minimal friction between the stem assembly S and the housing H. In this regard it should be further noted that the roller 102 of roller bearing 92 is tapered inwardly. This facilitates the roller bearing carrying the weight of the housing as well as the loading produced by the torque due to the rotation of the stem assembly S.

The power swivel P of the present invention has many advantages in addition to the structural stability and loading characteristics mentioned above. The wash plate 26 forms a very effective and durable seal between the fluid passageways F and F' and the remaining structure of the power swivel P. Additionally, the splined engagement of the stem assembly S with the motor M provides a direct drive for the stem assembly S and thereby eliminates the power losses experienced in the geared structures of known power swivels. Further, the fluid passageways F and F' and each of the elements of the power swivel P is substantially symmetrical about the central longitudinal axis 238 of the power swivel. Since the motor M extends circumferentially about the stem assembly S, the motor is not unduly exposed to damage from other apparatus being used on a drill platform, as were the radially spaced motors of known power swivels. Further, the symmetry of the power swivel P about the central axis 238 ensures that the center of gravity of the power swivel is along the line defined by the axis 238. This is particularly advantageous in handling the power swivel P because the power swivel may easily be placed on the center line of the borehole. Having the center of gravity easily positionable directly over the centerline of the borehole is also particularly important when the power assembly P is used for running flexible, lightweight tubing. In this latter use, the power swivel P overcomes the problems of undesirable torques exerted on the lightweight tubing by known power swivels which did not have a center of gravity that was readily alignable over the centerline of the borehole.

Power swivel P is particularly useful in downhole cementing operations. When used in such operations, the upper housing member 10 may be coupled to a pump in sub which, in turn, is affixed to cement inlets and pump inlets, an elevator sub, and a lifting bail. The coupling stem 22 of the power swivel P can be attached to a ball valve and a cementing head as described in my co-pending application for "Cementing Head", filed concurrently herewith and having attorneys docket file No. A-7195. The fluid passageways F and F′ provide means for conveying the cement and mud from the respective inlets mounted with the upper housing member 10 to the ball valve and the cementing head. Additionally, the power swivel P rotates the casing in the well as the entire assembly is reciprocated vertically by the lifting bail attached to the elevator sub.

It should be understood, however, that the power swivel P has many uses in addition to that of downhole cementing operations. For example, it may also be used for drilling with small pipe or tubing, and for milling, downhole fishing, cutting, and coring operations. Many other uses will also be apparent to those skilled in the art.

It should be understood that the foregoing disclosure and description of the invention are illustrative and explanatory thereof, and various changes in size, shape and materials as well as the details of the illustrated construction may be made without departing from the spirit of the invention.

What is claimed is:

1. A power swivel assembly, comprising:

a housing have a non-rotating axial housing passageway therein for receiving working fluid under pressure and passing working fluid through at least a portion of said housing;

a stem assembly mounted for rotational movement with respect to said housing and having a stem assembly bore therethrough in fluid communication with said housing passageway for receiving working fluid under pressure from said housing passagewy and passing working fluid through said stem assembly;

an internal washpipe extending from a portion of said housing passageway into a portion of said stem assembly bore permitting sealable fluid communication of working fluid between said non-rotating housing passageway and said rotating stem assembly bore;

first seal means between said washpipe and said housing;

second seal means between said washpipe and said stem assembly;

hollow bore motor means having a central bore and mounted with said housing and receiving said stem assembly through said central bore;

said motor means having rotor means with a rotor bore forming at least a portion of said central bore of said motor means, said motor means being powered by motor fluid reacting on said rotor means thereof;

said rotor means having internal drive connection means on the inner surface of said rotor bore; and said stem assembly having external driving means on the external surface of said stem assembly in rotational driving engagement with said internal drive connection means on the inner surface of said rotor bore, whereby said motor means is directly connected with said stem assembly.

2. The structure set forth in claim 1, wherein said internal and external drive connection means includes:

interengaging spline members on said inner surface of said rotor means and on said external surface of said stem assembly.

3. The structure set forth in claim 1, wherein said rotor means includes:

a plurality of vanes adapted to be actuated by fluid pressure; and means for directing fluid pressure to said vanes for rotating same to thereby rotate said stem assembly.

4. The structure of claim 1, including:

a safety ring of a larger diameter than said washpipe and disposed externally of said second seal means;

a first safety seal between said safety ring and said housing; and, a second safety seal between said ring and said stem assembly.

5. The structure of claim 1, including:

bearing means between said housing and said stem assembly for anti-friction rotational support of said stem assembly with said housing; a lubricant cavity formed between said housing and said stem assembly in which said bearing means is located; and, said lubricant cavity being located externally of said safety ring and said seals therewith for preventing fluid which may leak through said second seal means from entering said lubricant cavity.

* * * * *